US010415187B2

(12) United States Patent
Guo et al.

(10) Patent No.: US 10,415,187 B2
(45) Date of Patent: Sep. 17, 2019

(54) METHOD FOR PREPARING MOLDED ARTICLE FROM CHINESE HERB RESIDUE AND MOLDED PRODUCT OBTAINED THEREOF

(71) Applicant: INFINITUS (CHINA) COMPANY LTD., Jiang Men, Guangdong (CN)

(72) Inventors: Dong Guo, Guangdong (CN); Yansheng Huang, Guangdong (CN); Quancai Zhang, Guangdong (CN); Liuyun Hu, Guangdong (CN); Qingtao Tang, Guangdong (CN)

(73) Assignee: INFINITUS (CHINA) COMPANY LTD., Jiang Men, Guangdong (CN)

( * ) Notice: Subject to any disclaimer, the term of this patent is extended or adjusted under 35 U.S.C. 154(b) by 33 days.

(21) Appl. No.: 15/692,176

(22) Filed: Aug. 31, 2017

(65) Prior Publication Data

US 2018/0100272 A1 Apr. 12, 2018

(30) Foreign Application Priority Data

Oct. 12, 2016 (CN) ..... 2016 1 0890797

(51) Int. Cl.

| | |
|---|---|
| ***D21H 11/12*** | (2006.01) |
| ***D21B 1/02*** | (2006.01) |
| ***D21C 5/00*** | (2006.01) |
| ***D21J 3/00*** | (2006.01) |

(52) U.S. Cl.

CPC ..... *D21H 11/12* (2013.01); *D21B 1/02* (2013.01); *D21C 5/00* (2013.01); *D21J 3/00* (2013.01)

(58) Field of Classification Search

USPC ..... 162/13, 91

See application file for complete search history.

(56) References Cited

U.S. PATENT DOCUMENTS

| | | | | |
|---|---|---|---|---|
| 5,741,400 | A * | 4/1998 | Kwak | A61L 15/40 162/158 |
| 6,379,495 | B1 * | 4/2002 | Giovannozzi Sermanni | D21O 5/00 162/57 |
| 6,841,101 | B2 * | 1/2005 | Nakos | B27N 1/00 156/256 |
| 2007/0028801 | A1 * | 2/2007 | Yamasaki | A61K 47/38 106/163.01 |

(Continued)

*Primary Examiner* — Jacob T Minskey

(74) *Attorney, Agent, or Firm* — Yue (Robert) Xu; Apex Attorneys at Law, LLP

(57) ABSTRACT

The present invention relates to the field of molding and the field of pulping and papermaking, particularly relates to a method for preparing molded article from Chinese herb residue and molded article obtained thereof. The preparation method is: Chinese herb residue is chipped and water is added to adjust the concentration to obtain a feed solution; the feed solution is subjected to refining, untwining and beating to obtain a Chinese herb residue slurry; the Chinese herb residue slurry is molded, dried and shaped through hot pressing to obtain molded article. The method provided by the present invention achieves the resource utilization of Chinese herb residues, which not only provides raw materials for papermaking industry and molding industry, but also reduces the environmental burden caused by landfill and incineration of Chinese herb residues, and also can substitute paper pulp and reduce the consumption of paper pulp.

10 Claims, 6 Drawing Sheets

(56) References Cited

U.S. PATENT DOCUMENTS

2015/0361616 A1* 12/2015 Essaddam ..... C08H 8/00
162/60

* cited by examiner

METHOD FOR PREPARING MOLDED ARTICLE FROM CHINESE HERB RESIDUE AND MOLDED PRODUCT OBTAINED THEREOF

CROSS-REFERENCE TO RELATED APPLICATIONS

The present application claims the priority of Chinese Patent Application No. 201610890797.6, as filed on Oct. 12, 2016 and titled with "METHOD FOR PREPARING MOLDED ARTICLE FROM CHINESE HERB RESIDUE AND MOLDED PRODUCT OBTAINED THEREOF", and the disclosure of which is incorporated herein by reference.

FIELD

The present invention relates to the field of molding and the field of pulping and papermaking, particularly relates to a method for preparing molded article from Chinese herb residue and molded product obtained thereof.

BACKGROUND

With the development of Traditional Chinese Medicine (TCM) industry, a large amount of Chinese herb residues is generated by hospitals, Chinese medicine enterprises and health care enterprises every year. Counting roughly, the annual production amount of Chinese herb residues in China is up to more than 30 million tons. At present, the Chinese herb residues from most enterprises are disposed by ways of landfill, incineration, even using for feeds and composts, etc. Landfill, incineration and the like potentially harm the environment, also waste the herb residues resource. The range of herb residues which can be used for feed supplements is relatively narrow and the usage is also quite small; also the herb residues composting cycle is relatively long, the disposing capacity is relatively low.

There are still lots of meaningful research on the resource utilization of Chinese herb residues, for example using for cultivation substrate of edible fungus, etc.; for preparation of bio-ethanol and biogas by fermentation; for disposing wastewater and preparing biochar, etc. Chinese herb residues have a broad source and a large variety, the production quantity is large amount. However, these disposing methods have low demand for herb residues, certain limits to the type of herb residues, and no advantage on cost. Hence, it is hard to consume the large amount of herb residues on a large scale.

China has a large pulping and papermaking industry, paper and cardboard production per year is up to 100 million tons, however, the raw materials for pulp and paper in China are heavily dependent on imports. According to statistics, in China, the amount of imported paper pulp used for papermaking was up to 16.85 million tons and the amount of imported waste paper up to 29.24 million tons in 2013. As China's unique plant fiber waste, Chinese herb residue is a usable raw material for papermaking, the main components are cellulose, hemicellulose and lignin. However, since Chinese herb residue is the residue of herbaceous plants after water or organic solvent extraction, it has many shortcomings compared with traditional papermaking raw materials, such as too short fiber length, too many impurities, too much pigment, etc. So Chinese herb residue is not an ideal papermaking raw material.

Molded pulp article uses paper pulp as raw material, some chemicals are added, the paper article is molded into certain shapes on a molding machine with special molds. It can be used as food boxes, tableware, packing linings and industrial cushioning packaging materials. Due to its good buffer protection performance and environmental friendly characteristic, the development of pulp molded article is very rapid. However, there is little research on how to prepare Chinese herb residue into qualified molded articles.

At present, a large amount of herb residues is generated from the preparation process of Chinese medicine, such as Ganodermae, Glycyrrhizae Radix et Rhizoma, *Astragalus membranaceus* (Fisch.) Bunge, Angelicae *Sinensis* Radix, Leonuri Herba, *Morindae Officinalis* Radix, Salviae Miltiorrhizae Radix, *Panacis* Quinquefolii Radix, etc. Research and development of a waste recourses cyclic utilization method using Chinese herb residue becomes an inevitable trend of technological development.

SUMMARY

In view of the above, embodiments of the present invention provides a method for preparing molded article from Chinese herb residue and molded article obtained thereof. The method achieves the resource utilization of Chinese herb residues, which not only provides raw materials for papermaking industry and molding industry, but also reduces the environmental burden caused by landfill and incineration of Chinese herb residues, and also can replace pulp and reduce the consumption of pulp.

In order to achieve the above-mentioned object of the present disclosure, the following technical solutions are provided.

An embodiment of the present disclosure provides a method for preparing molded article from Chinese herb residue, comprising:

treatment of herb residual raw material, wherein Chinese herb residue is subjected to chipping and water is added to adjust the concentration to obtain a feed solution;

refining and beating, wherein the feed solution is subjected to refining and beating to obtain a Chinese herb residue slurry; and molding, wherein the herb residue slurry is subjected to molded, dried and shaped through hot pressing to obtain a molded pulp article.

The present disclosure adopts a pure mechanical pulping method, prepares Chinese herb residue into a slurry with a certain concentration, adopts molding process, and prepares molded articles having a wide range of uses. The method achieves the reasonable utilization of Chinese herb, not only reduces the environmental burden, but also can substitutes a portion of waste paper. The present method can achieve industrialization by adopting pure mechanical pulping and molding process, has good economic and ecological benefits, and is meaningful to the sustainable development of related enterprises.

In the present disclosure, Chinese herb residue is a herb residue of one or more Chinese medicines after water or organic solvent extraction.

In the embodiments of the present disclosure, the Chinese medicine is one or more of Ganodermae, Glycyrrhizae Radix et Rhizoma, *Astragalus membranaceus* (Fisch.) Bunge, Angelicae *Sinensis* Radix, Leonuri Herba, *Morindae Officinalis* Radix, Salviae Miltiorrhizae Radix, *Panacis* Quinquefolii Radix, *Edodes* Lentinus, Tremella, Flammulina velutipes (Fr.) Sing, Momordicae Fructus, *Cordyceps sinensis* (Berk.) Sacc, Lycii Fructus, Polygoni Multiflori Radix.

Preferably, the chipping treatment is using a slicer or a pulverizer to treat into small pieces of herb residue having thicknesses of 1.5 cm or less.

Preferably, the mass percentage concentration of the herb residue in the feed solution is 15%-20%.

In the embodiments provided by the present disclosure, the refining is carried out in a high consistency disc refiner and the spacing between the discs is set to be 0.5 mm-1.0 mm.

Preferably, the untwining is: the mass percentage concentration of the slurry produced by refining is adjusted to 1.5%-2.5%; added to a deflaker for untwining at a rotational speed of 15,000 r/min.

Preferably, the beating is carried out in a PFI refiner at a rotational speed of 500 r/min; the beating degree of the Chinese herb residue slurry is 40° SR-60° SR.

Preferably, a step adjusting the mass percentage concentration of the herb residue slurry of Ganodermae to be 0.5%-2.0% is also comprised between the beating and the molding.

In the present disclosure, the molded article is food box, tableware, packing pad or industrial buffer packaging material.

In the embodiments of the present disclosure, the method for preparing the molded article comprises:

- chipping the Chinese herb residue; adding water and adjusting the concentration to obtain a feed solution with a mass percentage concentration of 15%-20%;
- then refining the feed solution by a continuous high consistency refiner to obtain a raw refined slurry of herb residue;
- adjusting the mass percentage concentration of the raw refined slurry of herb residue to be 1.5%-2.5%; adding to a deflaker for untwining at a rotational speed of 15,000 r/min; then performing beating by a PFI refiner after the completion of the untwining to obtain a fine refined slurry of herb residue;
- molding the fine refined slurry of herb residue in a molding machine to obtain a wet molded article; and
- drying the wet molded article by natural-air drying or hot air drying and shaping through hot pressing to obtain a molded article.

In the embodiments provided by the present disclosure, the refining is two-stage refining, the spacing between the discs of the first stage is controlled to be 1 mm, the spacing between the discs of the second stage is controlled to be 0.5 mm.

In the embodiments provided by the present disclosure, the revolution speed of the PFI refiner is controlled to be 500 r/min; the herb residue slurry obtained by operation at this speed is the best.

The molding machine used in the shaping operation is a self-made or industrial molding machine.

In the present disclosure, specifically, the method for preparing molded article comprises: one or more Chinese medicines of Ganodermae, Glycyrrhizae Radix et Rhizoma, *Astragalus membranaceus* (Fisch.) Bunge, Angelicae *Sinensis* Radix, Leonuri Herba, *Morindae Officinalis* Radix, Salviae Miltiorrhizae Radix, *Panacis* Quinquefolii Radix are subjected to water extraction to extract active ingredients, an herb residue remains, after slicing and crush treatment, water is added and the mass concentration is adjusted to be 15%-20%, two-stage refining is carried out by a continuous high consistency refiner, the spacing between the discs of the first stage is controlled to be 1 mm and the spacing between the discs of the second stage is controlled to be 0.5 mm; some of water is removed from the refined herb residue, the water content of the herb residue is determined, water is added and it is adjusted to 0.5%-2.5; untwining is carried out by a deflaker at a revolution of 15,000 r/min, and then concentration is carried out, beating treatment is carried out by a PFI refiner, the revolution speed of the refining of the PFI is controlled to be 500 r/min, a fine refined slurry of Chinese herb residue which can be used for molding is obtained; taking the fine refined slurry of Chinese herb residue, water is added and the mass percentage concentration of the Chinese herb slurry is adjusted to be 0.5%-2.0%, molding is carried out in a molding machine, a wet molded article is obtained; by nature-air drying or drying, then shaping through hot pressing, a molded article is obtained.

The present disclosure also provides molded articles produced by the preparation method.

Compared with the existing methods for resource utilization of Chinese herb residues, the present disclosure has the following advantages:

1) Water and energy saving: the Chinese herb residue generated by enterprises can be directly subjected to refining treatment, the refining process can make full use of the waste water from the cleaning of extraction equipment of the enterprises, water recycling is achieved. At the same time, carrying out the drying process of the molded article can make full use of the original well-off steam of the enterprises, the full utilization of heat energy is achieved. The whole production process makes full use of the available water resource and energy, extra water and energy consumption is reduced.

2) The present disclosure can achieve production industrialization, and the herb residue produced by the enterprises can be disposed in time.

3) The process of the present disclosure is simple and low cost: the herb residue produced by the enterprises can be directly subjected to refining without any treatment, no additive is added during the molding process, the production consumption is reduced and the cost of the enterprises is saved.

4) Environmental protection and economy: the herb residue can be used for molding, the environment stress caused by Chinese herb residue disposing methods such as landfill, incineration is relieved, environmental pollution is avoid, and the molded articles produced have a wide range of uses, the cyclic utilization of Chinese herb residue resources is achieved; a portion of pulp fiber is substituted, it is a typical development pattern of circular economy, has good economic and ecological benefits.

BRIEF DESCRIPTION OF DRAWINGS

FIG. 6-1 shows the concave surface of the self-made mold and FIG. 6-2 shows the convex surface of the self-made mold;

FIG. 7-1 and FIG. 7-2 show the concave surface of the laboratory molded article from the herb residue of Ganodermae, and FIG. 7-3 and FIG. 7-4 show the convex surface of the laboratory molded article from the herb residue of Ganodermae;

FIG. 8-1 and FIG. 8-2 show the convex surfaces of the laboratory molded articles from mixed herb residues, and FIG. 8-3 and FIG. 8-4 show the concave surfaces of the laboratory molded articles from mixed herb residues;

FIG. 9-1 shows the convex surface of industrial molded product 2, FIG. 9-2 shows the concave surface of industrial molded product 2, FIG. 9-3 shows the concave surface of industrial molded product 1, FIG. 9-4 shows the convex surface of industrial molded product 1.

DETAILED DESCRIPTION OF THE INVENTION

The present disclosure discloses a method for preparing molded article from Chinese herb residue and molded article obtained thereof. Those of ordinary skill in the art can use the contents of this disclosure for reference and improve the process parameters and achieve. It is to be pointed out that all similar substitutions and modifications are apparent to those skilled in the art and are considered to be included in the present disclosure. The method and use of the present disclosure have been described by way of preferred embodiments, and it is apparent that those concerned may make modifications or appropriate changes and combinations of the method and use described herein without departing from the spirit and scope of the present disclosure to achieve and apply the technology of the present disclosure.

The equipment or raw materials used in the method for preparing molded article from Chinese herb residue and molded article provided by the present disclosure are all commercially available.

The present invention is further illustrated according to the following examples:

Example 1

Figure 1:
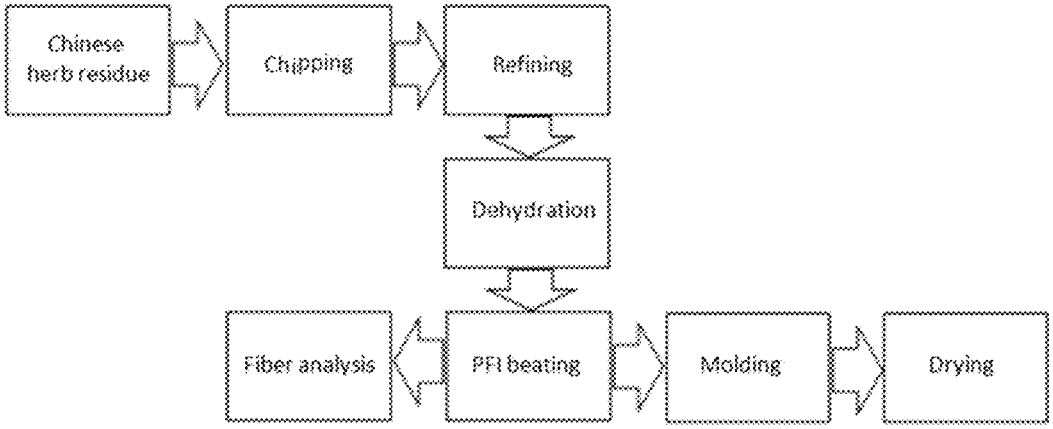
FIG. 1 shows the flow chart of molding process from Chinese herb residue.

The flow chart of Chinese herb residue molding process in this example is shown in FIG. 1. The specific preparation method for molded article is as follows:

1) Treatment of herb residual raw material: 2,500 g Chinese herb residue (main component was Ganodermae after extraction, containing a small amount of other residue such as *Edodes* Lentinus, Tremella, the ratio is no more than 30%), large pieces of Ganodermae were chipped, the mass concentration was adjusted to be 20%, preparing for refining in the next step.

2) Refining and beating: after homogenization treatment, the slurry was subjected to two-stage refining by a continuous high consistency refiner, the spacing between the discs of the first stage was 1 mm, and the spacing between the discs of the second stage was 0.5 mm. The herb residue slurry after refining was put into a spin-dryer spinning drying and removing some of the water, the water content of the herb residue was determined by a rapid moisture meter, water was added and the mass concentration was adjusted to be 2%, untwining was carried out by a deflaker (the revolution speed was 15,000 r/min), and then beating was carried out by a PFI refiner, the revolution of the PFI refiner was controlled to be 500 r/min, the beating degree was 40° SR, a fine refined slurry of herb residue which can be used for molding was obtained.

Figure 2:
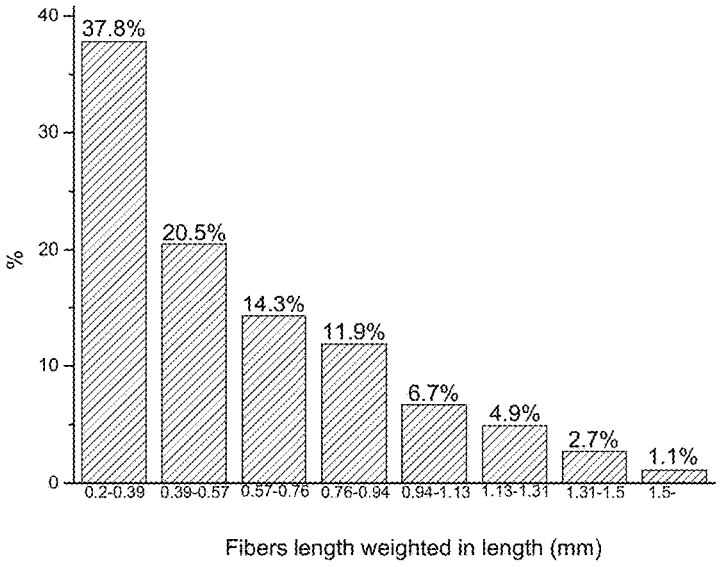
FIG. 2 shows the fiber length distribution of Chinese herb residue in Example 1.

3) Analysis of fiber quality: the fiber quality of Ganodermae residue slurry was analyzed by a fiber quality analyzer and the fiber length distribution is shown in FIG. 2. The average fiber length of Ganodermae residue was over 600 μm and the content of the fiber over 400 μm was greater than 65%, it can be used for the preparation of molded article.

Figures 1, 6:
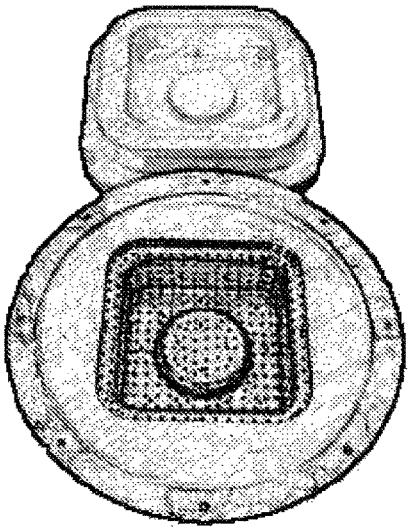
Figures 2, 6:
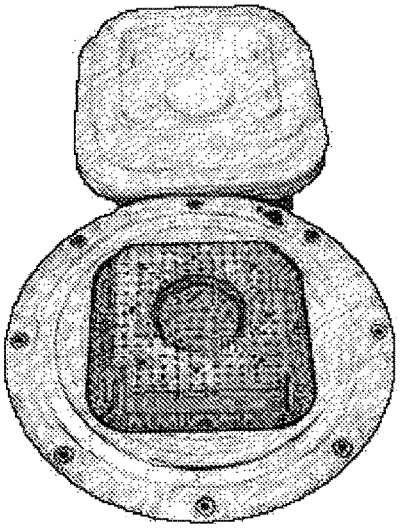
Figures 1, 7:
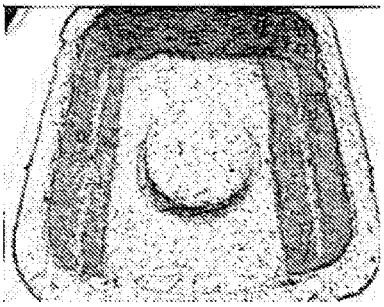
Figures 2, 7:
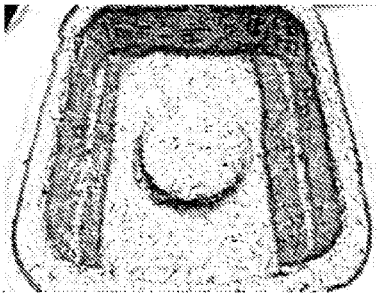
Figures 3, 7:
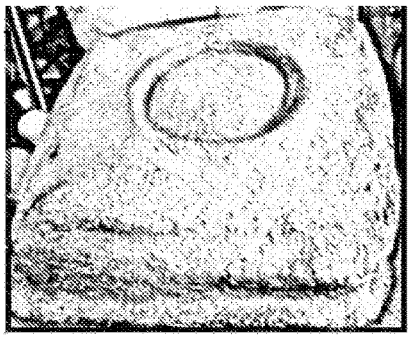
Figures 4, 7:
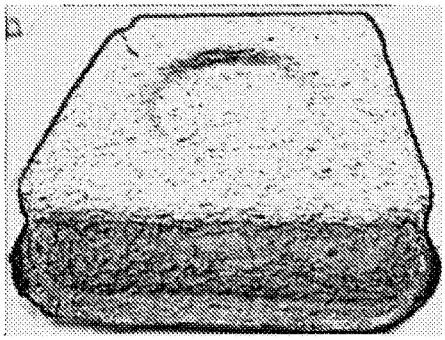
Figures 1, 8:
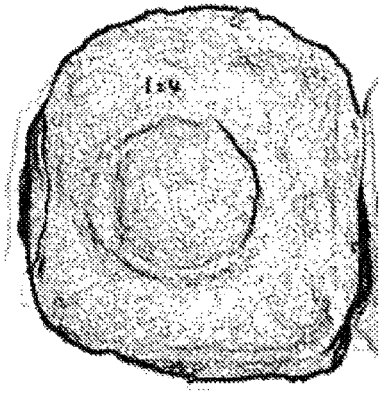
Figures 2, 8:
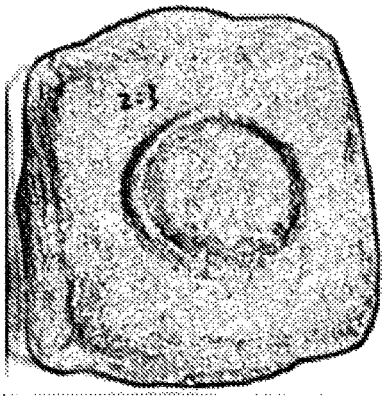
Figures 3, 8:
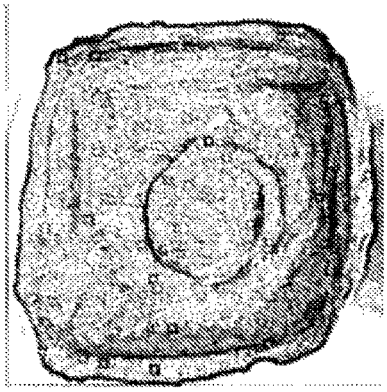
Figures 4, 8:
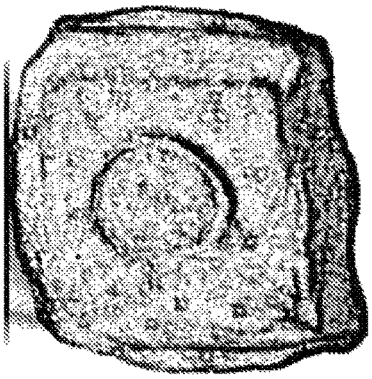
Figures 1, 9:
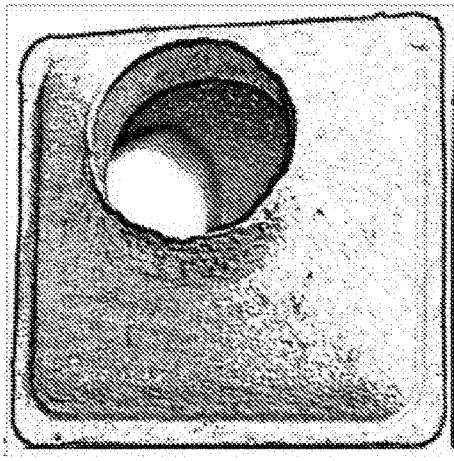
Figures 2, 9:
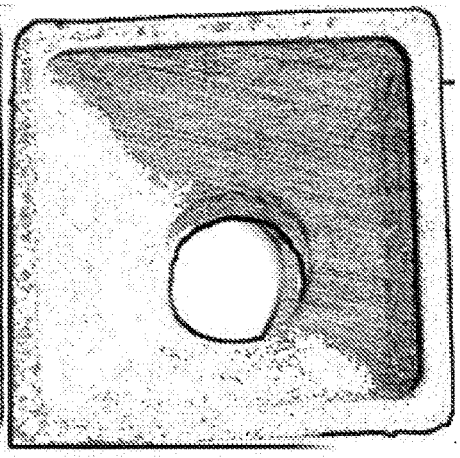
Figures 3, 9:
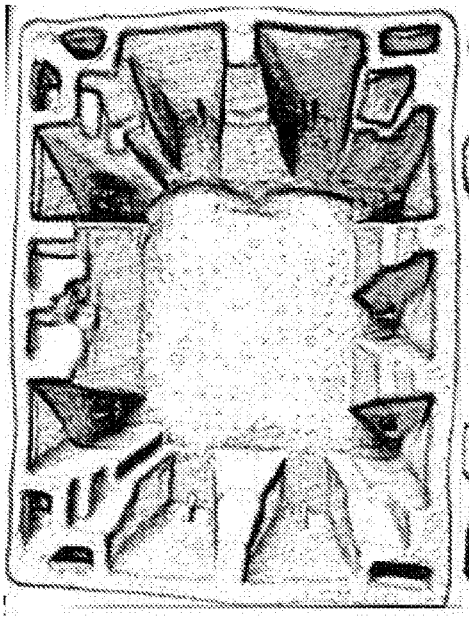
Figures 4, 9:
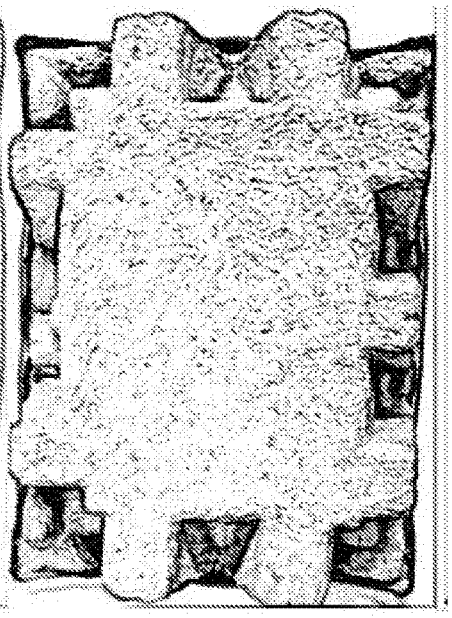

4) Molding: water was added and the solid matter concentration in the fine refined slurry was adjusted to be about 1%, molding was carried out by the self-made molding machine and a wet molded article was obtained, dried by natural air, and a molded article was obtained. The picture of the self-made mold was shown in FIG. 6-1 and FIG. 6-2 and the picture of the molded article was shown in FIG. 7-1, FIG. 7-2, FIG. 7-3 and FIG. 7-4. As shown in the figure, the molded article was in a good shape and has certain application value.

Example 2

The method for preparing molded article in this example is as follows:

1) Treatment of herb residue raw material: 2,500 g herb residue of Acanthopanacis Senticosi Radix et Rhizoma seu Caulis, *Panacis* Quinquefolii Radix, and Rhodiolae Crenulatae Radix et Rhizoma (the ratio of the Chinese medicines was 7:5:12), large pieces were chipped, the mass concentration was adjusted to be 15%, preparing for refining in the next step.

2) Refining and beating: after homogenization treatment, the slurry was subjected to two-stage refining by a continuous high consistency refiner, the spacing between the discs of the first stage was 1 mm and the spacing between the discs of the second stage was 0.5 mm. Water was added and the mass concentration was adjusted to be 2.5%. Untwining was carried out by a deflaker (the revolution was 15,000 r/min), and then beating was carried out by a PFI refiner, the revolution of the PFI refiner was controlled to be 500 r/min, the beating degree was 60° SR, a fine refined slurry of herb residue which can be used for molding was obtained.

Figure 3:
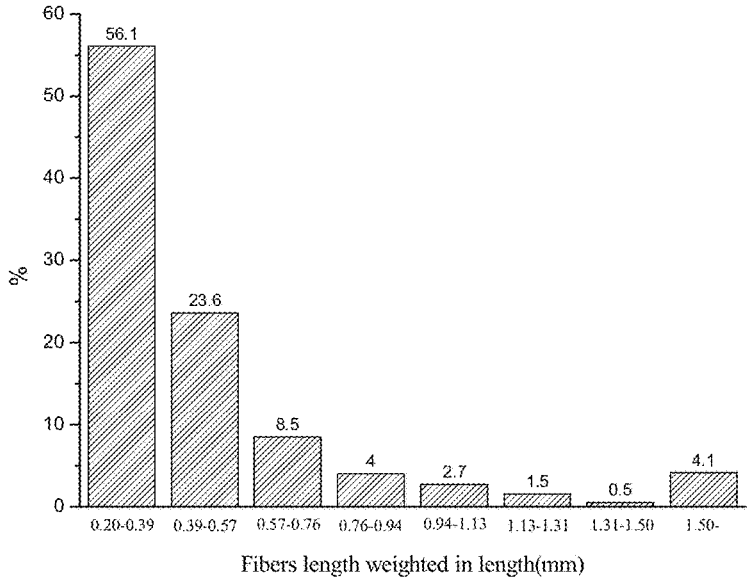
FIG. 3 shows the fiber length distribution of Chinese herb residue in Example 2.

3) Analysis of fiber quality: the fiber quality of the herb residue slurry was analyzed by a fiber quality analyzer and the fiber length distribution is shown in FIG. 3. The average fiber length of the herb residue was over 490 μm and the content of the fiber over 400 μm was greater than 44%, it can be tried to be used for the preparation of molded article.

4) Molding: water was added and the solid matter concentration in the fine refined slurry was adjusted to be about 0.8%, molding was carried out by the self-made molding machine and a wet molded article was obtained, dried by natural air, and a molded article was obtained.

Example 3

The method for preparing molded article in this example is as follows:

1) Treatment of herb residue raw material: 2,500 g herb residue of Leonuri Herba, Angelicae *Sinensis* Radix and Glycyrrhizae Radix et Rhizoma, large pieces ofAngelicae *Sinensis* Radix were chipped, the mass concentration was adjusted to be 18%, preparing for refining in the next step.

2) Refining and beating: after homogenization treatment, the slurry was subjected to two-stage refining by a continuous high consistency refiner, the spacing between the discs of the first stage was 1 mm and the spacing between the discs of the second stage was 0.5 mm. Water was added and the mass concentration was adjusted to be 1.5%. Untwining was carried out by a deflaker (the revolution was 15,000 r/min), and then beating was carried out by a PFI refiner, the revolution of the PFI refiner was controlled to be 500 r/min, the beating degree was 50° SR, a fine refined slurry of herb residue which can be used for molding was obtained.

Figure 4:
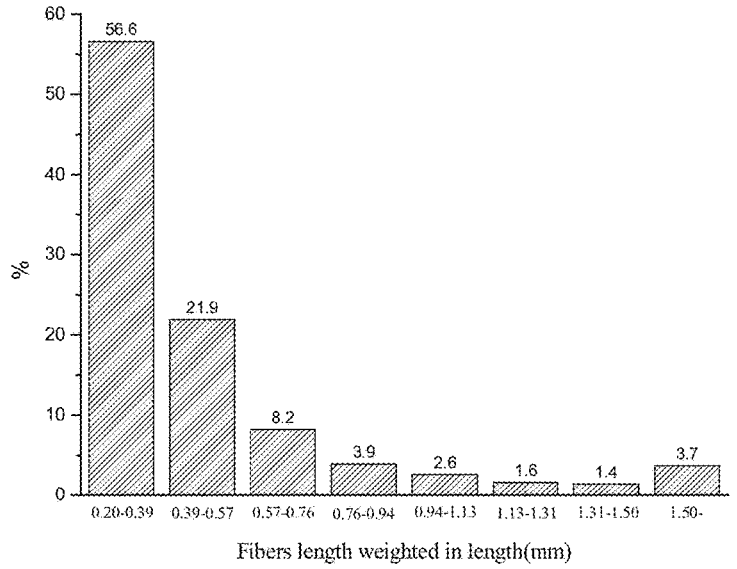
FIG. 4 shows the fiber length distribution of Chinese herb residue in Example 3.

3) Analysis of fiber quality: the fiber quality of the herb residue slurry was analyzed by a quality fiber analyzer and the fiber length distribution is shown in FIG. 4. The average fiber length of herb residue was over 480 μm and the content of the fiber over 400 μm was greater than 43%, it can be tried to be used for the preparation of molded article.

4) Molding: water was added and the solid matter concentration in the fine refined pulp was adjusted to be about 2.0%, molding was carried out by the self-made molding machine and a wet molded article was obtained, dried by natural air, and a molded article was obtained. The picture of the self-made mold was the same as FIG. 6-1 and FIG. 6-2 and the picture of the molded article was similar to FIG. 7-1, FIG. 7-2, FIG. 7-3 and FIG. 7-4. As shown in the figure, the molded article was in a good shape and has certain application value.

Example 4

The method for preparing molded article in this example is as follows:

1) Treatment of herb residue raw material: 2,500 g herb residue of Ganodermae (the component was the Ganodermae after water extraction), large pieces of Ganodermae were chipped, the mass concentration was adjusted to be 16%, preparing for refining in the next step.

2) Refining and beating: after homogenization treatment, the slurry was subjected to two-stage refining by a continuous high consistency refiner, the spacing between the discs of the first stage was 1 mm and the spacing between the discs of the second stage was 0.5 mm. Water was added and the mass concentration was adjusted to be 2%. Untwining was carried out by a deflaker (the revolution was 15,000 r/min), beating was carried out by a PFI refiner, the revolution of the PFI refiner was controlled to be 500 r/min, the beating degree was 52° SR, a fine refined slurry of herb residue which can be used for molding was obtained.

Figure 5:
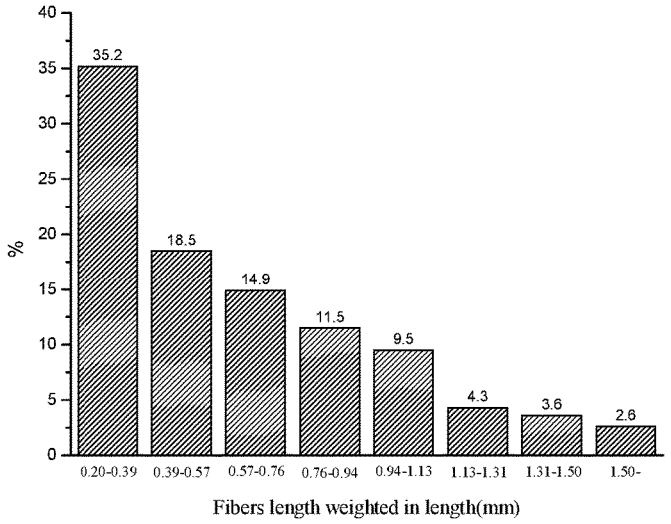
FIG. 5 shows the fiber length distribution of Chinese herb residue in Example 4.

3) Analysis of fiber quality: the fiber quality of Ganodermae herb residue slurry was analyzed by a fiber quality analyzer and the fiber length distribution is shown in FIG. 5. The average fiber length of the herb residue of Ganodermae was over 600 μm and the content of the fiber over 400 μm was greater than 64%, it can be used for the preparation of molded article.

4) Molding: water was added and the solid matter concentration in the fine refined slurry was adjusted to be about 0.5%, molding was carried out by the self-made molding machine and a wet molded article was obtained, dried by natural air, and a molded article was obtained. The picture of the self-made mold was the same as FIG. 6-1 and FIG. 6-2 and the picture of the molded article was similar to FIG. 7-1, FIG. 7-2, FIG. 7-3 and FIG. 7-4. It can be found that the molded article was in a good shape and has certain application value.

Example 5

Some other herb residues with less fiber content were added to the herb residue which was mainly the herb residue of Ganodermae and then molding was carried out. The specific steps are as follows:

1) Treatment of herb residue raw material: 2,500 g Chinese herb residue (the main component was the Ganodermae after extraction, with a small amount of other herb residue such as *Edodes* Lentinus) was mixed with some other herb residues such as Tremella, Lycii Fructus, Poria. The ratio of the herb residue of Ganodermae to the added herb residue was 4:1. Large pieces of Ganodermae were chipped, the mass concentration was adjusted to be 20%, preparing for refining in the next step.

2) Refining and beating: after homogenization treatment, the slurry was subjected to two-stage refining by a continuous high consistency refiner, the spacing between the discs of the first stage was 1 mm and the spacing between the discs of the second stage was controlled to be 0.5 mm. The herb residue slurry after refining was put into a spin-dryer spinning drying and removing some of the water, the water content of the herb residue was determined by a rapid moisture meter, water was added and the mass concentration was subjected to be 2%. Untwining was carried out by a deflaker (the revolution was 15,000 r/min), beating was carried out by a PFI refiner, the revolution of the PFI refiner was controlled at 500 r/min, the beating degree was 43° SR, a fine refined slurry of herb residue which can be used for molding was obtained.

3) Molding: water was added and the solid matter concentration in the fine refined pulp was adjusted to be about 1.2%, molding was carried out by the self-made molding machine and a wet molded article was obtained, dried by natural air, and a molded article was obtained. The pictures of the molded articles from different ratios of herb residues are shown in FIG. 8-1, FIG. 8-2, FIG. 8-3 and FIG. 8-4. There was a slight deformation in the molded article from mixed herb residue, the molded article would still have a wide range of uses if was subjected to shaping through hot pressing.

Example 6

This example is a pilot experiment of the herb residue of Ganodermae, and the specific implementation steps are as follows:

1) Treatment of herb residue raw material: a Chinese herb residue which was equivalent to 16.6 kg oven-dry pulp (main component was Ganodermae after extraction, containing a small amount of other Chinese herb residues such as *Edodes* Lentinus, Tremella), large pieces of Ganodermae were chipped, the mass concentration was adjusted to be 20%, preparing for refining in the next step.

2) Refining: after homogenization treatment, the slurry was subjected to two-stage refining by a continuous high consistency refiner, the spacing between the discs of the first stage was 1 mm and the spacing between the discs of the second stage was controlled to be 0.5 mm.

3) Molding: the pilot experiment adopts two completely different molds in order to ensure the versatility of the experimental results. The volume of the pilot study pulp pool was 1.66 $m^3$. The herb residue slurry was poured into the pulp pool and the concentration was adjusted to be 1%. Molding was carried out in two different molds.

4) Results showed that: by adjusting parameters such as vacuum degree, water filtering time, thickness between molds, both of the molds could produce molded article with good shapes, the air-dried products were further subjected to treatment of shaping through hot pressing. It could be found that: compared with the molded articles made by the self-made molding machine, the surface smoothness of the products improved obviously, the strength of the products enhanced significantly and the appearance was more beautiful. The pictures of the molded articles from pilot test are shown in FIG. 9-1, FIG. 9-2, FIG. 9-3 and FIG. 9-4.

5) The parameters of the pilot experiment mainly are: the water filtering time was 25 s, the thickness between upper and lower mold was 30 mm, the hot-pressing temperature was 150° C.

The foregoing is only preferred embodiments of the present disclosure and it should be pointed out that a number of improvements and modifications may be made by those of ordinary skill in the art without departing from the principles of the present disclosure, these improvements and modifications should also be regarded within the scope of the present disclosure.

The invention claimed is:

1. A method for preparing molded article from Chinese herb residue, comprising:

1) treatment of herb residue material: Chinese herb residue is subjected to chipping treatment, water is added to adjust the concentration to obtain a feed solution;
2) refining and beating: the feed solution is subjected to refining, untwining and beating to obtain a herb residue slurry; and
3) molding: the Chinese herb residue slurry is subjected to molded, dried and shaped by hot pressure to obtain a molded article.

2. The method according to claim 1, wherein the Chinese herb residue is herb residue of a Chinese medicine after water or organic solvent extraction; the Chinese medicine is one or more of Ganodermae, Glycyrrhizae Radix et Rhizoma, *Astragalus membranaceus* (Fisch.) Bunge, Angelicae *Sinensis* Radix, Leonuri Herba, *Morindae Officinalis* Radix, Salviae Miltiorrhizae Radix, *Panacis* Quinquefolii Radix, *Edodes* Lentinus, Tremella, Flammulina velutipes (Fr.) Sing, Momordicae Fructus, *Cordyceps sinensis* (Berk.) Sacc, Lycii Fructus and Polygoni Multiflori Radix.

3. The method according to claim 1, wherein the chipping treatment is performed by a slicer or a pulverizer to treat the Chinese herb residue into small pieces having a thickness of 1.5 cm or less.

4. The method according to claim 1, wherein the mass percentage concentration of the Chinese herb residue in the feed solution is 15%-20%.

5. The method according to claim 1, wherein the refining is carried out by a high consistency disc refiner and spacing between discs is set to be 0.5 mm-1.0 mm.

6. The method according to claim 1, wherein the untwining is: the mass percentage concentration of the feed solution after refining is adjusted to 1.5%-2.5%; the feed solution is added to a deflaker for untwining at a rotational speed of 15,000 r/min.

7. The method according to claim 1, wherein the beating is carried out by a PFI refiner at a speed of 500 r/min and beating degree is 40° SR-60° SR.

8. The method according to claim 1, further comprising a step between the beating and the molding, wherein the step is adding water and adjusting the mass percentage concentration of the Chinese herb residue slurry to be 0.5%-2.0%.

9. The method according to claim 1, wherein the molded article is a lunch box, tableware, packing pad or industrial buffer packaging material.

10. The method according to claim 1, wherein the method comprises:

chipping the Chinese herb residue;

adding water and adjusting concentration to obtain a feed solution with a mass percentage concentration of 15%-20%;

refining the feed solution by a continuous high consistency disc refiner to obtain a raw refined slurry of herb residue;

adjusting a mass percentage concentration of the raw refined slurry of herb residue to be 1.5%-2.5%, adding to a deflaker for untwining at a rotational speed of 15,000 r/min, performing beating treatment by a PFI refiner after completion of the untwining to obtain a fine refined slurry of herb residue;

molding the fine refined slurry of herb residue in a molding machine to obtain a wet molded article; and shaping the wet molded article through hot pressing after natural-air drying or hot air drying to obtain a molded article.

* * * * *